US007241562B2

(12) United States Patent
Bertucci et al.

(10) Patent No.: US 7,241,562 B2
(45) Date of Patent: Jul. 10, 2007

(54) COLOR PHOTOGRAPHIC ELEMENT HAVING IMPROVED SPEED

(75) Inventors: Sidney J. Bertucci, Rochester, NY (US); David M. Teegarden, Pittsford, NY (US); David E. Decker, Rochester, NY (US); Thomas H. Whitesides, Somerville, MA (US); Larry D. Edwards, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 58 days.

(21) Appl. No.: 10/761,495

(22) Filed: Jan. 21, 2004

(65) Prior Publication Data

US 2005/0158674 A1 Jul. 21, 2005

(51) Int. Cl.

| | |
|---|---|
| ***G03C 1/46*** | (2006.01) |
| ***G03C 1/005*** | (2006.01) |
| ***G03C 1/494*** | (2006.01) |
| ***G03C 1/06*** | (2006.01) |
| ***G03C 1/08*** | (2006.01) |

(52) U.S. Cl. ..... 430/502; 430/503; 430/543; 430/531; 430/546; 430/627; 430/629; 430/631; 430/636; 430/517; 430/374; 430/390

(58) Field of Classification Search ..... 430/502, 430/503, 543, 531, 546, 627, 629, 631, 636, 430/517, 374, 390

See application file for complete search history.

(56) References Cited

U.S. PATENT DOCUMENTS

| | | | |
|---|---|---|---|
| 4,388,402 | A | 6/1983 | Mukunoki |
| 4,710,456 | A | 12/1987 | Naoi et al. |
| 4,923,788 | A | 5/1990 | Shuttleworth et al. |
| 5,547,832 | A | 8/1996 | Yarmey et al. |
| 5,753,422 | A | 5/1998 | Shibahara et al. |
| 5,972,591 | A | 10/1999 | Yarmey et al. |
| 6,146,818 | A | 11/2000 | Gonzalez et al. |
| 6,428,947 | B1 | 8/2002 | Johnston et al. |

FOREIGN PATENT DOCUMENTS

WO 92/11570 A 7/1992

OTHER PUBLICATIONS

Research Disclosure No. 23406, "Viscosity-Increasing Agent for Photographic Coating Compositions", Oct. 1983, pp. 311-312.

Yasushi Nozawa et al., "Damage to High Speed Color Negative Films from Natural Background Radiation", Journal of Imaging Science and Technology, vol. 46, No. 3, May/Jun. 2002, pp. 270-276.

*Primary Examiner*—Geraldina Visconti
(74) *Attorney, Agent, or Firm*—Andrew J. Anderson; Paul A. Leipold; Sarah M. Roberts

(57) ABSTRACT

This invention relates to a color silver halide photographic element comprising gelatin, a support bearing at least one dye image forming unit selected from a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler; and a polymer represented by Formula 1.

(1)

wherein:

A independently represents a bond or a group linking the polymer chain to the $SO_3^-M^+$ group(s), $R_1$ independently represents H or a lower alkyl group of from 1 to 4 carbon atoms, $M^+$ independently represents an alkali or alkaline earth metal ion or an ammonium or substituted ammonium ion, Z independently represents at least one ethylenically unsaturated, hydrophilic monomer, and a and b represent the weight percent of the respective monomers where a is between 0 and 95%, b is between 5 and 100%, and n is 1 or 2; and wherein the average molecular weight of the polymer is less than about 300,000 and the total amount of the polymer contained in the silver halide element is greater than 1.0% of the total amount of gelatin contained in the silver halide element. It further relates to a method of processing said element.

46 Claims, No Drawings

COLOR PHOTOGRAPHIC ELEMENT HAVING IMPROVED SPEED

FIELD OF THE INVENTION

This invention relates to silver halide color photographic materials and in particular to a silver halide color photographic material having enhanced sensitivity to visible light and to a method for improving the sensitivity of silver halide color photographic materials to visible light.

BACKGROUND OF THE INVENTION

Sensitivity to visible light is a defining parameter of silver halide color photographic materials. For color negative photographic films there continues to be a strong desire to increase this sensitivity. In practice, there are two basic means for improving the response of film to a visible light exposure. On the one hand, the response can be improved by increasing the response of the light-sensitive silver halide emulsion elements used to prepare the film. This may take the form of increasing emulsion grain size, utilizing a more efficient emulsion morphology such as tabular silver halide grains, or improving emulsion sensitization. Increasing emulsion grain size has the drawback that such an increase at a constant amount of coated silver will decrease the number of imaging grains and thus will necessarily result in an undesirable increase in film granularity. Use of an emulsion morphology more efficient at absorbing exposing light such as tabular grains having a high dyed surface area to volume ratio is only beneficial if a sensitization for such grains can be found which will allow the additional absorbed light to be processed by the grain as efficiently as the absorbed light was processed by the emulsion grains being replaced.

A second means of enhancing film sensitivity is to read out more of the information captured by the light sensitive elements already in the film. One method sometimes used to accomplish this is to extend the development time used in processing the film. This method, commonly referred to in the trade as push processing, is, however, not widely employed in high volume commercial processing labs. This is because for maximum throughput, the color processing protocols widely available in the trade such as the KODAK FLEXICOLOR (C-41) process employ a fixed time of development. As a result, commercial color negative films are constructed for optimum performance at the fixed development times employed by the most widely-available commercial processing protocols. Extending the development time for such films usually results not only in increased sensitivity (signal) but also in increased fog density (noise). It would be of great advantage if a means by which the enhanced sensitivity obtained by push processing color negative films could be realized in the widely available commercial color film trade processes such as C-41 and the like at the current fixed development times. It would be of still further advantage if the enhanced sensitivity could be obtained without the increased fog density that usually accompanies this enhanced sensitivity when the development time is extended during push processing.

It is also well known that there is a direct correlation between the sensitivity of color films to visible light and their sensitivity to environmental ionizing radiation. This sensitivity to environmental radiation leads to a decrease in visible light sensitivity and to an increase in minimum (fog) density. A practical means of reducing the negative effects of environmental ionizing radiation on color film sensitivity and fog density is also highly desirable.

Polymers containing sulfonate monomers have been described for controlling viscosity in the various layers in silver halide elements in U.S. Pat. Nos. 5,547,832 and 5,972,591. Polymers containing carboxylic acid monomers have been described as useful for increasing the sensitization width associated with extended time of development in a reversal process for silver halide elements containing monodisperse emulsion in U.S. Pat. No. 7,753,422. Polymers containing sulfonate monomers have also been described Naoi et al. in U.S. Pat. No. 4,710,456 as useful for increasing covering power in black and white photographic films. Naoi does not discuss the use of the polymers in silver halide color photographic materials.

The use of the blue light absorbing dye (Dye-1) as a yellow filter dye in a silver halide color photographic element has been disclosed previously by Shuttleworth et al in U.S. Pat. No. 4,923,788.

There is a continuing need for color silver halide photographic elements having increased sensitivity without a concomitant increase in fog.

SUMMARY OF THE INVENTION

This invention provides a color silver halide photographic element comprising gelatin, a support bearing at least one dye image forming unit selected from a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler; and a polymer represented by Formula 1.

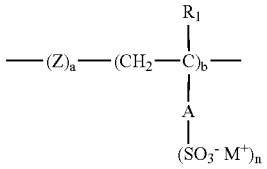

(1)

wherein:

A independently represents a bond or a group linking the polymer chain to the $SO_3^-M^+$ group(s), $R_1$ independently represents H or a lower alkyl group of from 1 to 4 carbon atoms, $M^+$ independently represents an alkali or alkaline earth metal ion or an ammonium or substituted ammonium ion, Z independently represents at least one ethylenically unsaturated, hydrophilic monomer, and a and b represent the weight percent of the respective monomers where a is between 0 and 95%, b is between 5 and 100%, and n is 1 or 2;

wherein the average molecular weight of the polymer is less than about 300,000 and the total amount of the polymer contained in the silver halide element is greater than 1.0% of the total amount of gelatin contained in the silver halide element. It further provides a method of processing said element.

In one embodiment the color silver halide photographic element further comprises a dye of the following structure:

Dye 1

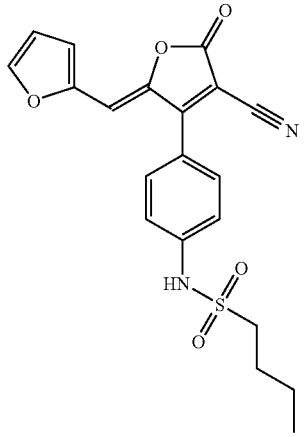

The present invention provides a silver halide color photographic material having improved sensitivity to visible light. In one embodiment the silver halide color photographic material has improved sensitivity to visible light while simultaneously showing a low increase in fog density. In another embodiment this invention also provides a silver halide color photographic material having improved sensitivity to visible light after exposure to ionizing radiation.

DETAILED DESCRIPTION OF THE INVENTION

The element of this invention is a silver halide color photographic element comprising gelatin and a support bearing at least one dye image forming unit selected from a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler; and a polymer. Preferably the element comprises a red sensitive layer, a green sensitive layer and a blue sensitive layer. Generally, the element comprises a cyan dye image forming unit comprising at least one red sensitive silver halide emulsion layer having associated therewith a cyan dye-forming coupler, a magenta dye image forming unit comprising at least one green sensitive silver halide emulsion layer having associated therewith a magenta dye-forming coupler, and a yellow dye image forming unit comprising at least one blue sensitive silver halide emulsion layer having associated therewith a yellow dye-forming coupler. For elements intended for digital scanning after exposure and processing and containing more than one image forming unit, however, the actual hue of the image dyes produced is of no importance. As discussed by Gonzalez et. al. in U.S. Pat. No. 6,146,818, what is essential in such elements is merely that the dye image produced in each of the image units be differentiable from that produced in each of the remaining image layer units.

The polymer utilized in the invention is represented by Formula 1.

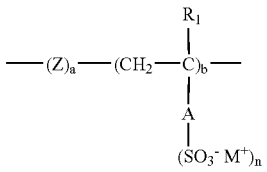

(1)

wherein:

A independently represents a bond or a group linking the polymer chain to the $SO_3^-M^+$ group(s), $R_1$ independently represents H or a lower alkyl group of from 1 to 4 carbon atoms, $M^+$ independently represents an alkali or alkaline earth metal ion or an ammonium or substituted ammonium ion, Z independently represents at least one ethylenically unsaturated, hydrophilic monomer, and a and b represent the weight percent of the respective monomers wherein a is between 0 and 95%, b is between 5 and 100%, and n is 1 or 2.

Comonomers Z useful in this invention include a large number of ethylenically unsaturated, hydrophilic monomers capable of undergoing chain-growth polymerization with the other monomer providing the repeat unit above under the reaction conditions employed. Z is preferably selected from the acrylamide family, including acrylamide, methacrylamide, N-methylacrylamide, N,N-dimethylacrylamide, N-methylmethacrylamide, N,N-dimethylmethacrylamide, N-ethylacrylamide, N-n-propylacrylamide, N-isopropylacrylamide, N-t-butylacrylamide and the like. Z may be the same or different throughout the polymer.

A is preferably an aryl, acyl or ether group. Examples of A include arylene, $C(O)OR_2$, $C(O)NR_3R_2$, $C(O)N(R_2)_2$, $OC(O)R_2$, and $OR_2$, where $R_3$ is the same as previously defined for $R_1$, and $R_2$ represents an optionally substituted alkylene, cyclic alkylene, aromatic, or ethyleneoxy group having from 1 to about 10 carbon atoms. In a preferred embodiment for A, $R_3$ is H and $R_2$ is $CH_2CH_2$, $CH_2CH_2CH_2$, $CH_2CH_2CH_2CH_2$, $CH(CH_3)CH_2$, $CH(CH_3)CH_2CH_2$, $C(CH_3)_2CH_2$, or $C(CH_3)_2CH_2CH_2$. Particularly preferred examples of the sulfonate-containing monomer are 2-methacryloyloxyethane-1-sulfonic acid, sodium salt, 3-acryloyloxypropane-1-sulfonic acid, sodium salt, 3-acryloyloxypropane-1-sulfonic acid, potassium salt, 3-methacryloyloxypropane-1-sulfonic acid, potassium salt, 2-acrylamido-2-methylpropane-1-sulfonic acid, sodium salt, and styrenesulfonic acid, sodium salt. The sulfonate containing monomers may be the same or different.

Preferably b is greater than 20% by weight of the polymer, more preferably b is greater than 50% by weight of the polymer, and most preferably b is greater than 70% by weight of the polymer.

Examples of polymers that are useful in the invention include the following (numbers outside of parentheses indicate comonomer weight percents):

P-1

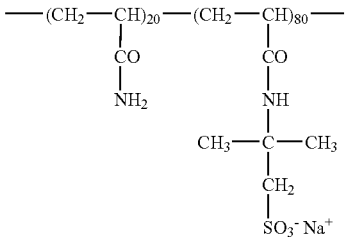

P-2

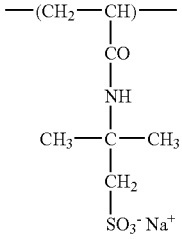

P-3

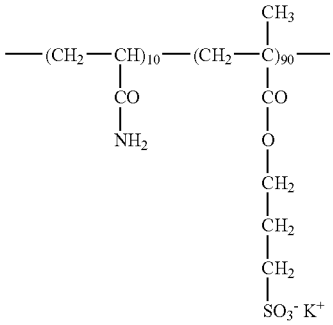

P-4

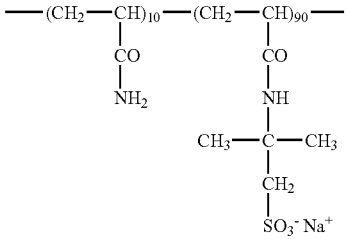

P-5

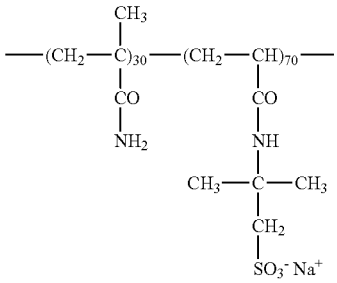

P-6

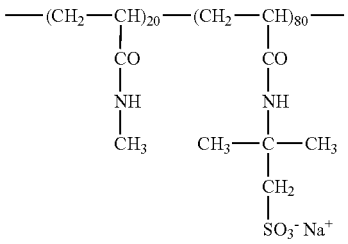

Polymers like those of Formula 1 for use as thickeners in silver halide color photographic elements have been described previously by Yarmey et al in U.S. Pat. No. 5,972,591 and U.S. Pat. No. 5,547,832. In those disclosures, the useful molecular weight range for the polymer was specified at between about 400,000 and 1,000,000. As discussed therein, this molecular weight range was necessary to achieve the desired thickening effect in specific layers of the photographic element during coating. In the present invention, where high levels of polymers of Formula 1 are desirable in many layers and where thickening of the coating melts is undesirable, the high molecular weight range specified by Yarmey et al for polymers like those of Formula 1 is specifically not useful to achieve the objects of the present invention.

To achieve the objects of the present invention it is highly preferred that the combination of the amount of the invention polymer contained in any layer of the photographic element and the invention polymer molecular weight does not significantly increase the viscosity of the layer in which it is coated. In one embodiment the viscosity of the coating layer melt containing the polymer is no more than 100% higher than the viscosity of the same layer without the polymer. Preferably the viscosity of the layer containing the polymer is no more than 50% higher than the viscosity of the same layer without the polymer, and most preferably no more than 10% higher. Accordingly, the average molecular weight of the polymers useful in the present invention is less than about 300,000, and more preferably less than about 200,000. The lower molecular weight polymers of the present invention may be used beneficially in combination with the higher molecular weight polymers specified by Yarmey et. al.

The total amount of the polymer contained in the silver halide element is greater than about 1.0% by weight of the total amount of gelatin contained in the silver halide element. Preferably the total amount of the polymer contained in the silver halide element is greater than 3.0% of the total amount of gelatin contained in the silver halide element and more preferably the total amount of the polymer contained in the silver halide element is greater than 5.0% of the total amount of gelatin contained in the silver halide element.

The polymer may be used in one or more gelatin containing layers as a gelatin replacement. In this case the amount of gelatin used in a standard formulation for a layer is actually decreased and replaced with the polymer. In this case the polymer may replace 5% to 30% by weight of the gelatin contained in the layer, more preferably the polymer may replace 5% to 25% by weight of the gelatin contained in the layer and most preferably the polymer replaces 5% to 20% by weight of the gelatin contained in the layer. In one suitable embodiment the polymer is dissolved in water and the resulting solution is used to replace gelatin in the layer melt(s).

The polymer may also be added to one or more gelatin containing layers as an addendum. In this case the amount of gelatin in a standard formulation is not decreased. In this embodiment the polymer is preferably added in the amount of 5% to 35% by weight of the gelatin contained in the layer, more preferably the polymer is added in the amount of 5% to 30% by weight of the gelatin contained in the layer and most preferably the polymer is added in the amount of 5% to 25% by weight of the gelatin contained in the layer the polymer.

In one preferred embodiment the silver halide color photographic element of the invention further comprises a dye of the following structure Dye-1

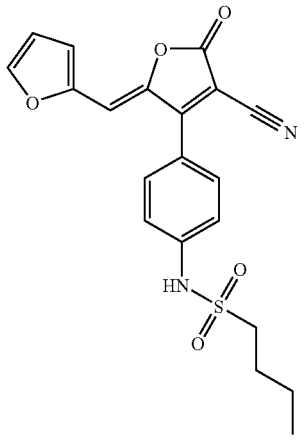

Dye-1 has been utilized as a yellow filter dye. However, when this dye is used in a photographic element also containing a polymer of Formula 1, the benefits of the polymer may be achieved with less increase in fog before and especially after exposure to ionizing radiation. While the benefits of the dye are realized when the dye is placed in the photographic element so as to be useful as a yellow filter dye, it is surprisingly equally useful in the present invention when it is incorporated in the photographic element containing the invention polymer even when its light absorbing ability is of no significance. In fact, the dye is more useful in the present invention when it is not incorporated into the photographic element containing a polymer of Formula 1 in such a way as to be useful as a yellow filter dye. Accordingly, in silver halide color photographic elements having the traditional layer order, that is, starting from the support, red-sensitive layers, then green-sensitive layers, and finally blue-sensitive layers, the dye utilized in the invention is useful in reducing fog when incorporated in the usual blue light filtering layer between the yellow and green sensitive layers. It is equally useful in reducing fog when incorporated elsewhere in the film. To take best advantage of the anti-fogging action of the dye without loss in film sensitivity due to light absorption by the dye, it is preferred that Dye-1 be incorporated into the film below the green-sensitive layers. The dye may be in the same layer as the polymer or in a different layer. Preferably the dye is incorporated in one or more non-imaging layers although the dye may be contained in one or more light sensitive layers with equal efficiency.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including a straight- or branched-chain or cyclic alkyl, such as methyl, trifluoromethyl, ethyl, t-butyl, and; alkenyl, such as ethylene, 2-butene; alkoxy, such as methoxy, ethoxy, propoxy, butoxy, 2-methoxyethoxy, sec-butoxy, hexyloxy, 2-ethylhexyloxy, and; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, 2-oxo-pyrrolidin-1-yl, N-succinimido, N-phthalimido, 2,5-dioxo-1-oxazolidinyl, and ethoxycarbonylamino, phenoxycarbonylamino, benzyloxycarbonylamino, phenylcarbonylamino, p-tolylcarbonylamino, N-methylureido, N,N-dimethylureido, N-phenylureido, and t-butylcarbonamido; sulfonamido, such as methylsulfonamido, benzenesulfonamido, p-tolylsulfonamido, N,N-dipropyl-sulfamoylamino, sulfamoyl, such as N-methylsulfamoyl, N-ethylsulfamoyl, N,N-dipropylsulfamoyl, N,N-dimethylsulfamoyl; carbamoyl, such as N-methylcarbamoyl, N,N-dibutylcarbamoyl, acyl, such as acetyl, phenoxycarbonyl, methoxycarbonyl, butoxycarbonyl, ethoxycarbonyl, benzyloxycarbonyl,; sulfonyl, such as methoxysulfonyl, phenoxysulfonyl, methylsulfonyl, 1, phenylsulfonyl, and p-tolylsulfonyl; sulfinyl, such as methylsulfinyl, phenylsulfinyl, and p-tolylsulfinyl; thio, such as ethylthio, and p-tolylthio; acyloxy, such as acetyloxy, benzoyloxy, N-phenylcarbamoyloxy, N-ethylcarbamoyloxy, and cyclohexylcarbonyloxy; amine, such as phenylanilino, 2-chloroanilino, diethylamine, imino, such as, N-succinimido or 3-benzylhydantoinyl; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl;

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 10 carbon atoms, typically 1 to 8 carbon atoms and usually less than 7 carbon atoms, but greater numbers are possible depending on the particular substituents selected.

When the term "associated" is employed, it signifies that a reactive compound is in or adjacent to a specified layer where, during processing, it is capable of reacting with other components.

The elements of the invention are multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsion containing elements employed in this invention are preferably negative working elements. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728; 1,531,927; 1,533,039; 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as U.S. Pat. Nos. 2,367,531; 2,423,730; 2,474,293; 2,772,162; 2,895,826; 3,002,836; 3,034,892; 3,041,236; 4,333,999; 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as U.S. Pat. Nos. 2,311,082; 2,343,703; 2,369,489; 2,600,788; 2,908,573; 3,062,653; 3,152,896; 3,519,429; 3,758,309; 4,540,654; and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443; 2,407,210; 2,875,057; 3,048,194; 3,265,506; 3,447,928; 4,022,620; 4,443,536; and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; and U.S. Pat. Nos. 3,632,345; 3,928,041; 3,958,993; and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213 490; Japanese Published Application 58-172,647; U.S. Pat. Nos. 2,983,608 and 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193 389; EP 301 477; and U.S. Pat. Nos. 4,163,669; 4,865,956; and 4,923,784 may be useful. Also contemplated is use of the compositions in association with nucleating agents, development accelerators or their precursors (UK Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; and 4,543,323 and EP 96 570.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416, as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

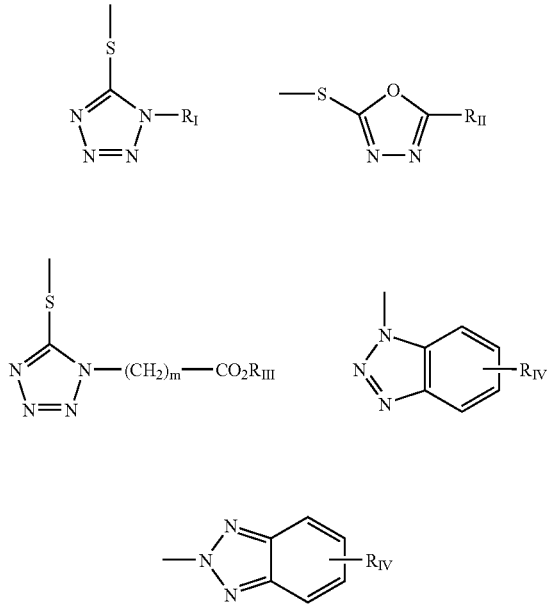

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG (photographically useful group) directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; and 4,861,701, Japanese Applications 57-188035; 58-98728; 58-209736; 58-209738); groups that function as a coupler or reducing agent after the coupler reaction (U.S. Pat. Nos. 4,438,193 and 4,618,571) and groups that combine the features describe above. It is typical that the timing group is of one of the formulas:

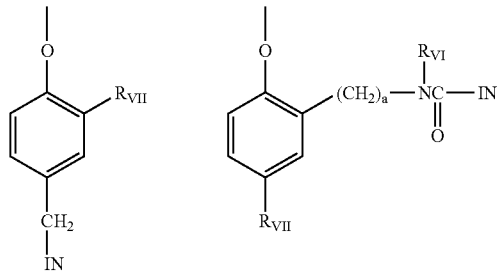

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

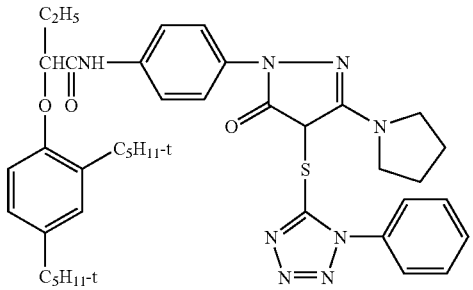

D2

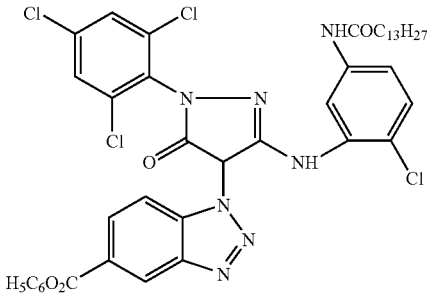

-continued

D3

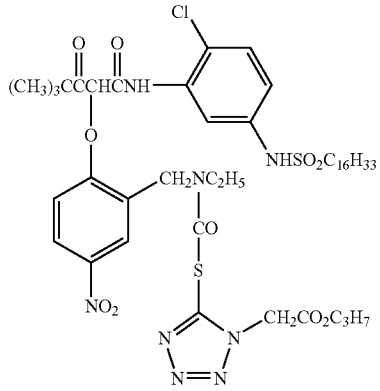

D4

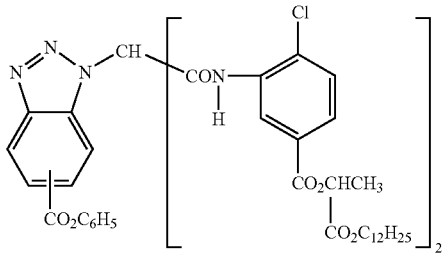

D5

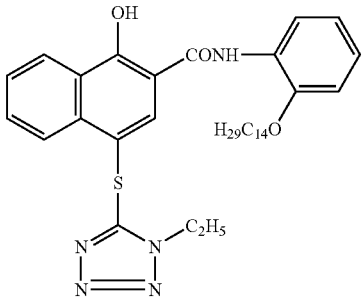

D6

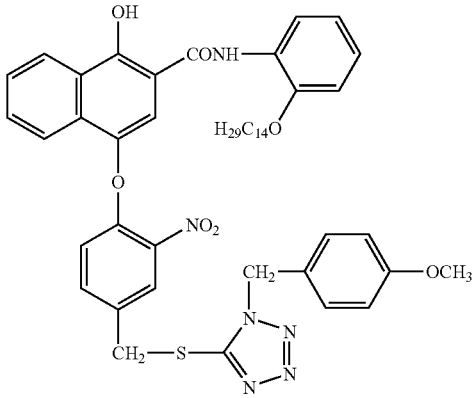

-continued
D7
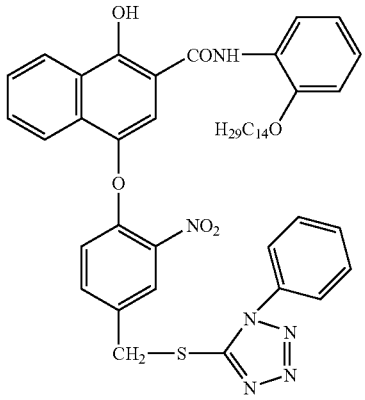
D8
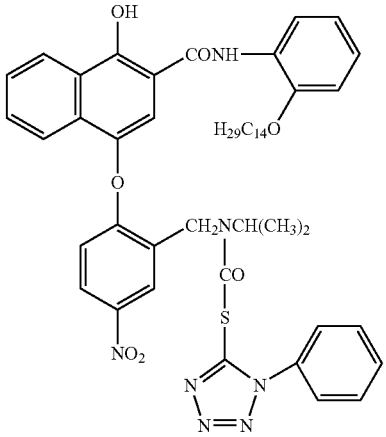
D9
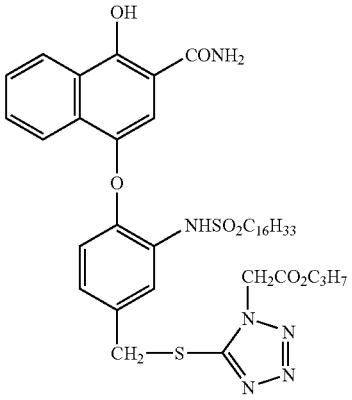
-continued
D10
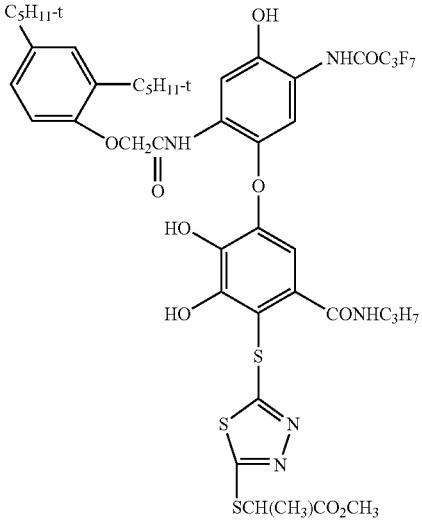
D11
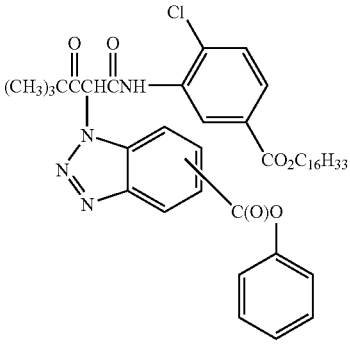
D12
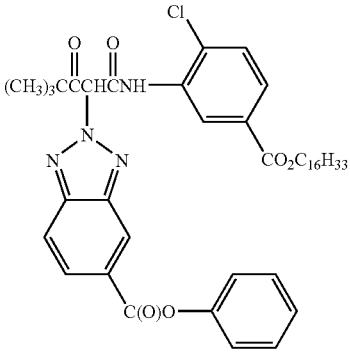

The silver halide used in the photographic elements may be silver iodobromide, silver bromide, silver chloride, silver chlorobromide, silver chloroiodobromide, and the like. High bromide emulsions are preferred, especially iodobromide emulsions. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 μm. Most preferably the average thickness of the tabular grains is less than 0.2 μm. In a specific preferred form the tabular grains are ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337; 5,292,632; 5,275,930; 5,607,828; and 5,399,477; House et al U.S. Pat. No. 5,320,938; Brust et al U.S. Pat. No. 5,314,798; Szajewski et al U.S. Pat. No. 5,356,764; Chang et al U.S. Pat. Nos. 5,413,904; 5,663,041; and 5,744,297; Budz et al U.S. Pat. No. 5,451,490; Reed et al U.S. Pat. No. 5,695,922; Oyamada U.S. Pat. No. 5,593,821; Yamashita et al U.S. Pat. Nos. 5,641,620 and 5,652,088, Saitou et al U.S. Pat. No. 5,652,089 and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; 4,173,320; and 5,411,851; 5,418,125; 5,492,801; 5,604,085; 5,620,840; 5,693,459; 5,733,718; Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771; 5,147,772; 5,147,773; 5,171,659; and 5,252,453; Black et al U.S. Pat. Nos. 5,219,720 and 5,334,495, Delton U.S. Pat. Nos. 5,310,644; 5,372,927; and 5,460,934; Wen U.S. Pat. No. 5,470,698; Fenton et al U.S. Pat. No. 5,476,760; Eshelman et al U.S. Pat. Nos. 5,612,175; 5,612,176; and 5,614,359; and Irving et al U.S. Pat. Nos. 5,695,923; 5,728,515; and 5,667,954; Bell et al U.S. Pat. No. 5,132,203; Brust U.S. Pat. Nos. 5,248,587 and 5,763,151, Chaffee et al U.S. Pat. No. 5,358,840; Deaton et al U.S. Pat. No. 5,726,007; King et al U.S. Pat. No. 5,518,872; Levy et al U.S. Pat. No. 5,612,177; Mignot et al U.S. Pat. No. 5,484,697; Olm et al U.S. Pat. No. 5,576,172; and Reed et al U.S. Pat. Nos. 5,604,086 and 5,698,387.

Ultrathin high bromide {111} tabular grain emulsions are illustrated by Daubendiek et al U.S. Pat. Nos. 4,672,027; 4,693,964; 5,494,789; 5,503,971; and 5,576,168, Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al, and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti et al U.S. Pat. No. 4,937,180; and Johnson et al U.S. Pat. No. 5,164,292. In addition, it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure*, Item 36736, published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention:

EXAMPLES

Example 1

This example shows that films without the polymers of this invention can achieve higher photographic sensitivity when they are push-processed, but that use of a polymer of this invention yields films which can match that higher sensitivity without the need for push-processing.

Comparative multilayer Film 101 was prepared by coating the following layers on cellulose triacetate. Layers are numbered beginning with the layer closest to the support. Coverages are in grams per meter squared unless otherwise stated. Relevant emulsion physical parameters and sensitizations and structures for chemical components are collected at the end of the example section. Film 101 was hardened by coating (Bisvinylsulfonyl)methane hardener at 1.80% of total gelatin weight. Antifoggants, surfactants, coating aids, coupler solvents, emulsion addenda, sequestrants, lubricants, static control agents, biocides, matte beads, and tinting dyes were added at appropriate levels as is common in the art.

Layers 5, 6, and 10 of comparative Film 101 contain a high molecular weight version of polymer P-1 as a thickening agent as taught by Yarmey et al in U.S. Pat No. 5,972,591. The molecular weight of this thickening polymer is much higher than the molecular weight described in the present invention.

Comparative Film Sample 101

Layer 1 (Antihalation layer) : black colloidal silver sol at 0.150; UV-1 and UV-2 each at 0.075; Chem-1 at 0.016; Chem-2 at 0.097 and gelatin at 1.991.

Layer 2 (Slow cyan layer): a blend of two red sensitized tabular silver iodobromide emulsions: Emul-1 at 0.341 and Emul-2 at 0.203; Coup-1 at 0.378; Coup-2 at 0.013; Coup-3 at 0.075, Coup-5 at 0.119; Coup-6 at 0.021; Coup-15 at 0.012 and gelatin at 1.831.

Layer 3 (Mid cyan layer): a red sensitized silver iodobromide emulsion Emul-4 at 0.535; Coup-1 at 0.184; Coup-2 at 0.032; Coup-4 at 0.070; Coup-5 at 0.056; Coup-6 at 0.017; Coup-15 at 0.072 and gelatin at 1.150.

Layer 4 (Fast cyan layer): a blend of two red sensitized tabular silver iodobromide emulsions: Emul-5 at 0.525 and Emul-6 at 0.250; Coup-1 at 0.087; Coup-2 at 0.045; Coup-3 at 0.032; Coup-5 at 0.012; Coup-6 at 0.050; Coup-15 at 0.030 and gelatin at 0.977.

Layer 5 (interlayer): Chem-1 at 0.025; Coup-2 at 0.016; polymer P-1 (outside of invention) at 0.004 and gelatin at 0.539.

Layer 6 (Slow magenta layer): a green sensitized tabular silver iodobromide emulsion: Emul-7 at 0.295; Coup-8 at 0.100; Coup-9 at 0.179; polymer P-1 (outside of invention) at 0.026 and gelatin at 1.164.

Layer 7 (Mid magenta layer): a blend of three green sensitized tabular silver iodobromide emulsions: Emul-7 at 0.120, Emul-10 at 0.485 and Emul-12 at 0.033, Coup-8 at 0.073; Coup-9 at 0.279; Coup10 at 0.007; Coup-11 at 0.029 and gelatin at 1.640.

Layer 8 (Fast magenta layer): a blend of two green sensitized tabular silver iodobromide emulsions: Emul-12 at 0.560 and Emul-13 at 0.440; Coup-3 at 0.003, Coup-8 at 0.082; Coup-9 at 0.079; Coup-10 at 0.016; Coup-11 at 0.013 and gelatin at 1.253.

Layer 9 (interlayer): Chem-1 at 0.025, Coup-14 at 0.016, and gelatin at 0.538.

Layer 10 (Slow yellow layer): a blend of three blue sensitized tabular silver iodobromide emulsions: Emul-14 at 0.195, Emul-15 at 0.335 and Emul-16 at 0.160; Coup-2 at 0.032; Coup-3 at 0.005; Coup-4 at 1.035; Coup-13 at 0.054; polymer P-1 (outside of invention) at 0.017 and gelatin at 1.746.

Layer 11 (Fast yellow layer): a blend of the tabular blue sensitized silver iodobromide emulsions Emul-17 at 0.650, the 3D blue sensitized silver iodobromide emulsion E-18 at 0.260, and a silver bromide Lippmann emulsions at 0.054; Coup-3 at 0.005; Coup-4 at 0.255; Coup-12 at 0.108; Coup-13 at 0.092; and gelatin at 0.950.

Layer 12 (UV filter layer): silver bromide Lippmann emulsion at 0.161; UV-1 at 0.105; UV-2 at 0.105 and gelatin at 0.690.

Layer 13 (Protective overcoat layer): poly(methylmethacrylate-methacrylic acid) polymer at 0.108 as matte beads; poly(methylmethacrylate) matte beads at 0.005; bis-(2-ethylhexyl) sulfosuccinate, sodium salt at 0.022; nonylphenoxy-poly(glycidol)(10) at 0.029; polydimethylsiloxane at 0.039 and gelatin at 0.866.

Invention polymer P-1 in which a=20 and b=80 having an average molecular weight of 65,500 daltons was used to replace gelatin in the layers of comparative film sample 101 to produce sample Films 103 thru 104 as shown in Table 1. In addition Dye-1 was added to layer 9 at a level of 0.11 in sample film 104.

Each of the films was given a stepped exposure for 0.01 seconds to a light source with an effective color temperature of 5500K. The exposed films were processed in the KODAK FLEXICOLOR (C-41) process as described in *British Journal of Photography Annual,* 1988, pp 196–198 except that in addition to the standard development time of 3'15", comparative Film 101 was also processed with a longer development time of 3'45". This push-processed sample of comparative Film 101 is identified in Table 1 as comparative film sample 102. Status M red, green, and blue densities were measured on each of the processed films.

The sensitivity of each film sample to light was taken as the reciprocal of the exposure necessary to produce a density of 0.15 above the density observed with no exposure, and a relative sensitivity was calculated for samples 102 thru 104 relative to the sensitivity of comparative sample 101. These relative sensitivities are recorded in Table 1 along with the densities produced when the films received no exposure ($D_{min}$, fog density). The data in Table 1 show that the use of the polymer P-1 allows the invention films to achieve the red and green record sensitivities after the standard 3'15" time of development that the comparative film achieves only after the longer 3'45" time of development (push-processing). Further, this higher sensitivity in the invention films is achieved with lower Dmin than in the comparative film after the necessary push-processing. The fog density in the invention film is particularly lowered by the simultaneous use of Dye 1.

TABLE 1

| Sample | Percent of Gel Replaced By Polymer P-1 | | | Dye 1 | | Relative Sensitivity | | | Dmin | | |
|---|---|---|---|---|---|---|---|---|---|---|---|
| No. | Layers 10–13 | Layers 6–9 | Layers 2–5 | (g/m$^2$) | TOD | R | G | B | R | G | B |
| 101 (comp.) | 0 | 0 | 0 | 0 | 3'15" | 1.00 | 1.00 | 1.00 | 0.30 | 0.77 | 1.03 |
| 102 (comp.) | " | " | " | " | 3'45" | 1.17 | 1.20 | 1.12 | 0.35 | 0.81 | 1.06 |
| 103 (Inv.) | 5 | 20 | 5 | 0 | 3'15" | 1.15 | 1.20 | 0.98 | 0.33 | 0.81 | 1.04 |
| 104 (Inv.) | 5 | 20 | 5 | 0.11 | 3'15" | 1.15 | 1.32 | 0.95 | 0.31 | 0.77 | 1.04 |

Example 2

This example shows that a low molecular weight polymer of the invention gives enhanced photographic sensitivity at a wide variety of levels and distribution in a high speed color negative film.

Comparative multilayer Film 201 was identical to comparative film 101 except that in comparative sample 201 the high molecular weight version of polymer P-1 (outside of this invention) used in Layers 5, 6, and 10 of 101 was also added to Layer 1 of comparative Film 201 at 0.065. Further, the gelatin in Layer 4 of 201 was increased to 1.100 and in Layer 11 was increased to 0.960

Invention polymer P-1 in which a=20 and b=80 having an average molecular weight of 65,500 daltons was used to replace gelatin in the layers of the comparative film sample 101 to produce sample Films 202 thru 212 as shown in Table 2.

TABLE 2

| Sample No. | Percent of Gel Replaced By Polymer P-1 Layers 10–13 | Layers 6–9 | Layers 2–5 | Relative Sensitivity R | G | B |
|---|---|---|---|---|---|---|
| 201 (comp.) | 0 | 0 | 0 | 1.00 | 1.00 | 1.00 |
| 202 (comp.) | 5 | 0 | 0 | 1.00 | 1.05 | 1.00 |
| 203 (Inv.) | 10 | 0 | 0 | 0.98 | 1.07 | 0.98 |
| 204 (Inv.) | 5 | 5 | 0 | 1.02 | 1.10 | 1.00 |
| 205 (Inv.) | 5 | 10 | 0 | 1.07 | 1.15 | 0.95 |
| 206 (Inv.) | 0 | 20 | 0 | 1.10 | 1.15 | 0.93 |
| 207 (Inv.) | 5 | 20 | 0 | 1.10 | 1.15 | 0.98 |
| 208 (Inv.) | 5 | 20 | 15 | 1.10 | 1.17 | 0.95 |
| 209 (Inv.) | 5 | 15 | 0 | 1.07 | 1.20 | 0.93 |
| 210 (Inv.) | 5 | 20 | 5 | 1.10 | 1.20 | 0.95 |
| 211 (Inv.) | 5 | 15 | 5 | 1.10 | 1.23 | 1.00 |
| 212 (Inv.) | 5 | 15 | 10 | 1.10 | 1.26 | 0.93 |

Each of the films was exposed through a granularity step tablet for 0.01 seconds to a light source with an effective color temperature of 5500K and processed in the KODAK FLEXICOLOR (C-41) process as described in *British Journal of Photography Annual,* 1988, pp 196–198. Status M red, green, and blue densities were measure on each of the processed films.

The sensitivity of each film sample to light was taken as the reciprocal of the exposure necessary to produce a density of 0.15 above the density observed with no exposure, and a relative sensitivity was calculated for the invention samples 202 thru 212 relative to the sensitivity of comparative sample 201. These relative sensitivities are recorded in Table 2. The data in Table 2 demonstrate the enhanced sensitivity of the films containing the invention polymer.

Example 3

This example shows that invention polymers of a range of molecular weights are useful in enhancing film sensitivity. Comparative film sample 301 was identical in composition to comparative film sample 201 in Example 2. Invention film samples 302 thru 304 each contained invention polymer P-1 in which a=20 and b=80. In each of the invention samples 202–204, a polymer was used to replace 5% of the gelatin in layers 10–13, 15% of the gelatin in layers 6–9, and 5% of the gelatin in layers 2–5. The samples differed only in the molecular weight (MW) of the invention polymer as shown in Table 3. Samples 301 thru 304 were exposed and processed as described in Example 2. The relative sensitivity of each film sample is shown in Table 3. The data in Table 3 demonstrate that the polymers of the invention are useful over a range of molecular weights.

TABLE 3

| Sample No. | MW of P-1 (Daltons × $10^{-3}$) | Relative Sensitivity R | G | B |
|---|---|---|---|---|
| 301 (comp.) | — | 1.00 | 1.00 | 1.00 |
| 302 (comp.) | 44.4 | 1.10 | 1.17 | 0.89 |
| 303 (Inv.) | 159 | 1.07 | 1.17 | 0.87 |
| 304 (Inv.) | 215 | 1.05 | 1.15 | 0.83 |

Example 4

This example shows that invention polymers of various monomer ratios are useful for enhancing film sensitivity. A high speed color negative film different from that in either comparative examples 101 or 201 was coated from the following formulation as comparative sample 401. Like film 101, film 401 was also hardened by coating (Bisvinylsulfonyl)methane hardener at 1.80% of total gelatin weight and antifoggants, surfactants, coating aids, coupler solvents, emulsion addenda, sequestrants, lubricants, static control agents, biocides, matte beads, and tinting dyes were added at appropriate levels as is common in the art.

Comparative Film Sample 401

Layer 1 (Antihalation layer): black colloidal silver sol at 0.150; UV-1 and UV-2 each at 0.075; Chem-1 at 0.016; Chem-2 at 0.125; polymer P-1 (outside of invention) at 0.065 and gelatin at 1.885.

Layer 2 (Slow cyan layer): a blend of two red sensitized tabular silver iodobromide emulsions: Emul-1 at 0.540 and Emul-3 at 0.260; Coup-1 at 0.592; Coup-2 at 0.056; Coup-3 at 0.096; Coup-15 at 0.024 and gelatin at 2.068.

Layer 3 (Mid cyan layer): a red sensitized tabular silver iodobromide emulsion, Emul-4 at 0.880; Coup-1 at 0.160; Coup-2 at 0.072; Coup-4 at 0.040; Coup-5 at 0.053; Coup-15 at 0.024 and gelatin at 1.121.

Layer 4 (Fast cyan layer): a blend of two red sensitized tabular silver iodobromide emulsions: Emul-5 at 0.480 and Emul-6 at 0.560; Coup-1 at 0.216; Coup-3 at 0.024; Coup-5 at 0.040; Coup-6 at 0.040; Coup-7 at 0.056; Coup-15 at 0.024 and gelatin at 1.266.

Layer 5 (interlayer): Chem-1 at 0.032, Chem-2 at 0.076; polymer P-1 (outside of invention) at 0.003 and gelatin at 0.540.

Layer 6 (Slow magenta layer): a blend of two green sensitized tabular silver iodobromide emulsions: Emul-8 at 0.180 and Emul-9 at 0.300; Coup-8 at 0.096; Coup-9 at 0.384; Chem-3 at 0.038; polymer P-1 at 0.008 and gelatin at 1.489.

Layer 7 (Mid magenta layer): a green sensitized tabular silver iodobromide emulsion, Emul-11 at 0.880; Coup-8 at 0.112; Coup-9 at 0.224; Coup 10 at 0.016; Coup-11 at 0.027; Chem-3 at 0.022 and gelatin at 1.640.

Layer 8 (Fast magenta layer): a blend of two green sensitized tabular silver iodobromide emulsions: Emul-12 at 0.320 and Emul-13 at 0.720; Coup-8 at 0.048; Coup-9 at 0.154, Coup-10 at 0.036; Chem-3 at 0.015 and gelatin at 1.277.

Layer 9 (interlayer): Chem-1 at 0.032, Chem-2 at 0.088, and gelatin at 0.800.

Layer 10 (Slow yellow layer): a blend of two blue sensitized tabular silver iodobromide emulsions: Emul-14 at 0.280 and Emul-15 at 0.136; Coup-1 at 0.036; Coup-3 at 0.0064; Coup-4 at 0.160; Coup-7 at 0.036; Coup-12 at 0.104; polymer P-1 (outside of invention) at 0.040 and gelatin at 1.076.

Layer 11 (Mid yellow layer): a blend of two blue sensitized tabular silver iodobromide emulsions: Emul-15 at 0.224 and Emul-16 at 0.256; Coup-4 at 0.960; Coup-13 at 0.080 and gelatin at 1.658.

Layer 12 (Fast yellow layer): a blend of two blue sensitized silver iodobromide emulsions: (i) a tabular emulsion Emul-17 at 0.320 and; (ii) a 3D emulsion Emul-18 at 0.680; Coup-3 at 0.0064; Coup-4 at 0.256; Coup-13 at 0.084; Chem-2 at 0.0048 and gelatin at 0.864.

Layer 13 (UV filter layer): silver bromide Lippmann emulsion at 0.215; UV-1 at 0.105; UV-2 at 0.105 and gelatin at 0.690.

Layer 14 (Protective overcoat layer): same as in Layer 13 in comparative example 101.

In each of the invention film samples 402–405, a polymer of the general structure P-1 was used to replace 20% of the gelatin in layers 7 thru 9. The polymers used in preparing sample Films 402–405 differed only in the ratio of the monomers (values for a and b shown in structure P-1) used to prepare the polymer as shown in Table 4.

TABLE 4

| Sample No. | a | b | Relative Sensitivity R | G | B |
|---|---|---|---|---|---|
| 401 (comp.) | no polymer | no polymer | 1.00 | 1.00 | 1.00 |
| 402 (Inv.) | 30 | 70 | 1.00 | 1.12 | 0.98 |
| 403 (Inv.) | 20 | 80 | 1.02 | 1.15 | 1.00 |
| 404 (Inv.) | 10 | 90 | 1.00 | 1.17 | 1.02 |
| 405 (Inv.) | 0 | 100 | 0.98 | 1.10 | 0.98 |

Samples 401–405 were exposed and processed as described in Example 2 except that for these samples the intensity of the exposing light was reduced by 0.2 log exposure units by placing a neutral density filter in the exposing beam. The relative sensitivities of the four invention films relative to the sensitivity of the comparative film are shown in Table 4. The data in Table 4 show that invention polymers of a range of compositions are useful in enhancing film sensitivity.

Example 5

This example shows that the utility of the invention polymers is enhanced when they are used in films containing a specific dye. It is well known that photographic materials are adversely affected by ionizing radiation. A particularly serious consequence of environmental ionizing radiation on photographic materials is the premature aging of the materials through high fog density ($D_{min}$). Since ionizing radiation is present throughout the environment it is desirable to identify any means possible to reduce its affects on photographic materials. Comparative film sample 501 was identical in composition to comparative film sample 201 in Example 2. Four invention film samples were prepared as follows.

Sample 502 was identical to Sample 501 except that the invention polymer P-1 was used to replace 5% of the gelatin in layers 10 thru 13, 20% of the gelatin in layers 6 thru 9, and 5% of the gelatin in layers 2 thru 5. Sample 503 was identical to sample 502 except that Dye-1 was added to Layer 5 at a level of 0.11.

Sample 504 was identical to Sample 501 except that the invention polymer P-1 was used to replace 15% of the gelatin in layers 10 thru 13, 20% of the gelatin in layers 6 thru 9, and 5% of the gelatin in layers 2 thru 5. Sample 505 was identical to sample 504 except that DYE-1 was added to layer 5 at a level of 0.11.

To simulate the effects of environmental ionizing radiation, one set of the five Films 501–505 were exposed uniformly to an Iridium-192 ionizing radiation source for sufficient time to produce a radiation exposure of 0.105 Roentgen (R). Both the irradiated and non-irradiated sets were then exposed to light and processed as described in Example 2. The relative sensitivities of the invention films relative to the comparative example are shown in Table 5. The data in Table 5 show that the invention polymers enhance sensitivity in both the irradiated and non-irradiated samples, and that in the irradiated films the enhancement is greater in the invention films containing Dye-1.

TABLE 5

| Sample No. | Percent of Gel Replaced By Invention Polymer: Layers 10–13 | Layers 6–9 | Layers 2–5 | Dye 1 (g/m²) | Relative Sensitivity after O R: R | G | B | Relative Sensitivity after 0.105 R: R | G | B |
|---|---|---|---|---|---|---|---|---|---|---|
| 501 (comp.) | 0 | 0 | 0 | 0 | 1.00 | 1.00 | 1.00 | 1.00 | 1.00 | 1.00 |
| 502 (comp.) | 5 | " | 5 | 0 | 1.10 | 1.20 | 0.95 | 1.07 | 1.15 | 1.00 |
| 503 (Inv.) | 5 | 20 | 5 | 0.11 | 1.10 | 1.17 | 0.98 | 1.07 | 1.23 | 1.02 |
| 504 (Inv.) | 5 | 20 | 15 | 0 | 1.10 | 1.17 | 0.95 | 1.10 | 1.20 | 1.00 |
| 505 (Inv.) | 5 | 20 | 15 | 0.11 | 1.12 | 1.15 | 0.95 | 1.10 | 1.23 | 1.00 |

The increase in minimum densities produced in both the irradiated and non-irradiated invention samples relative to the minimum densities produced in the comparative example are shown in Table 6.

TABLE 6

| Sample No. | Percent of Gel Replaced By Invention Polymer: Layers 10–13 | Layers 6–9 | Layers 2–5 | Dye 1 (g/m²) | Dmin Increase After O R: R | G | B | Dmin Increase After 0.105 R: R | G | B |
|---|---|---|---|---|---|---|---|---|---|---|
| 501 (comp.) | 0 | 0 | 0 | 0 | 0.00 | 0.00 | 0.00 | 0.00 | 0.00 | 0.00 |
| 502 (comp.) | 5 | 20 | 5 | 0 | 1.03 | 0.04 | 0.01 | 1.03 | 0.04 | 0.02 |
| 503 (Inv.) | 5 | 20 | 5 | 0.11 | 0.00 | 0.02 | 0.01 | 0.00 | 0.00 | 0.01 |
| 504 (Inv.) | 5 | 20 | 15 | 0 | 1.04 | 0.05 | 0.01 | 0.04 | 0.04 | 0.02 |
| 505 (Inv.) | 5 | 20 | 15 | 0.11 | 0.01 | 0.03 | 0.01 | 0.01 | 0.00 | 0.01 |

Taken together with the relative sensitivities for the same five film samples shown in Table 5, the data in Table 6 for samples 502 and 504 containing the invention polymer show increased minimum density along with enhanced sensitivity, while the data for samples 503 and 505 containing both the invention polymer and Dye-1 show that the enhanced sensitivity can be obtained with minimum or no increase in minimum density when the invention polymers are used in films containing Dye-1. The combination of the invention polymers and Dye-1 is particularly useful for irradiated samples.

Emulsions used in the examples

| Emulsion | type | microns diameter um | microns thickness um | % I | Sensitizing Dyes |
|---|---|---|---|---|---|
| Emul-1 | tabular | 0.44 | 0.11 | 0.5 | C-1 |
| Emul-2 | tabular | 0.7 | 0.11 | 4.5 | C-1 |
| Emul-3 | tabular | 0.95 | 0.13 | 4.5 | C-1 |
| Emul-4 | tabular | 1.28 | 0.12 | 3.7 | C-1 |
| Emul-5 | tabular | 2.3 | 0.13 | 3.7 | C-1 |
| Emul-6 | tabular | 3.9 | 0.13 | 3.7 | C-2 |
| Emul-7 | tabular | 0.47 | 0.12 | 3.0 | M-1 |
| Emul-8 | tabular | 0.47 | 0.12 | 4.5 | M-1 |
| Emul-9 | tabular | 0.79 | 0.11 | 4.5 | M-1 |
| Emul-10 | tabular | 1.18 | 0.12 | 4.5 | M-1 |
| Emul-11 | tabular | 1.28 | 0.13 | 4.5 | M-1 |
| Emul-12 | tabular | 2.3 | 0.13 | 4.5 | M-1 |
| Emul-13 | tabular | 2.9 | 0.13 | 3.7 | M-1 |
| Emul-14 | tabular | 0.53 | 0.08 | 1.3 | Y-1 |
| Emul-15 | tabular | 0.99 | 0.14 | 1.4 | Y-1 |
| Emul-16 | tabular | 1.26 | 0.114 | 4.1 | Y-1 |
| Emul-17 | tabular | 2.67 | 0.13 | 4.1 | Y-1 |
| Emul-18 | 3D | 1.22 | ****** | 9.7 | Y-2 |

where
C-1 = SD-1 + SD-2 + SD-3
C-2 = SD-1 + SD-2 + SD-4
M-2 = SD-5 + SD-6
Y-1 = SD-7 + SD-8
Y-2 = SD-7
Chem-1

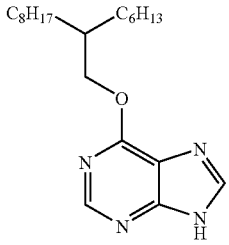

Chem-2

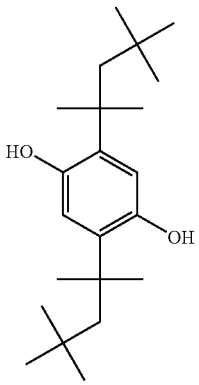

Chem-3

-continued
| Emulsions used in the examples | | | | | |
|---|---|---|---|---|---|
| | | microns | | | |
| Emulsion | type | diameter um | thickness um | % I | Sensitizing Dyes |
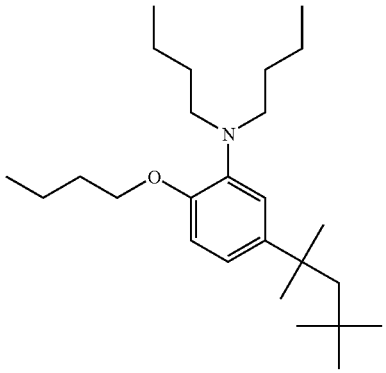
Coup-1
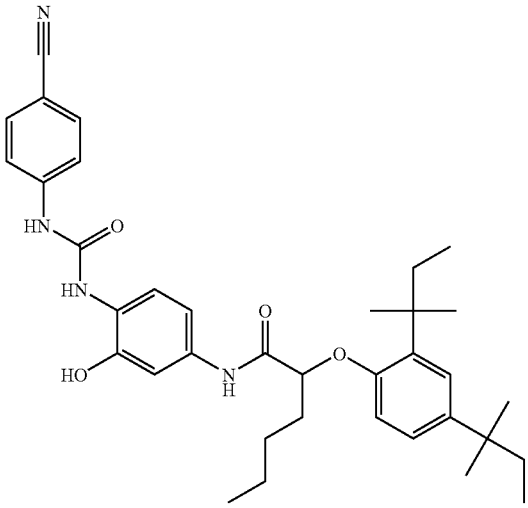
Coup-2

-continued
Emulsions used in the examples
| Emulsion | type | microns diameter um | microns thickness um | % I | Sensitizing Dyes |
|---|---|---|---|---|---|
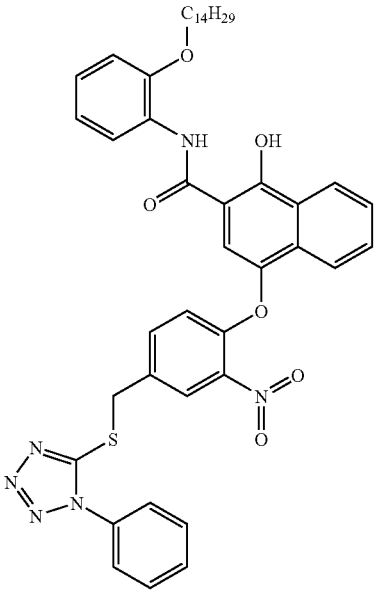
Coup-3
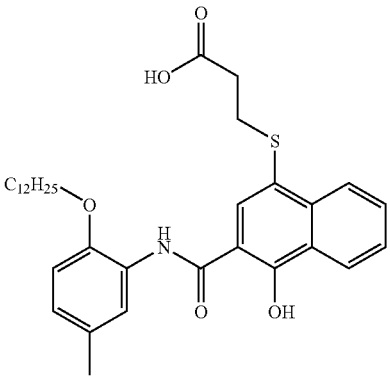
Coup-4
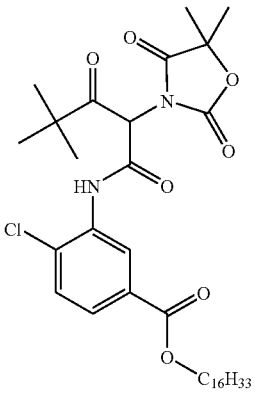
Coup-5

-continued
| Emulsions used in the examples | | | | | |
|---|---|---|---|---|---|
| | | microns | | | |
| Emulsion | type | diameter um | thickness um | % I | Sensitizing Dyes |
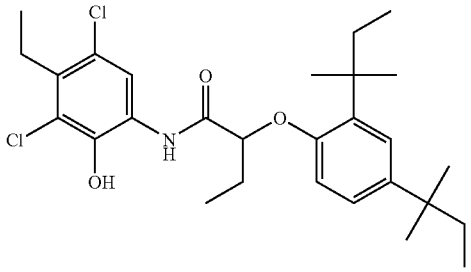
Coup-6
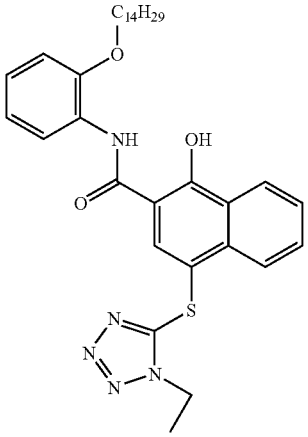
Coup-7

-continued
| Emulsions used in the examples | | | | | |
|---|---|---|---|---|---|
| | | microns | | | |
| Emulsion | type | diameter um | thickness um | % I | Sensitizing Dyes |
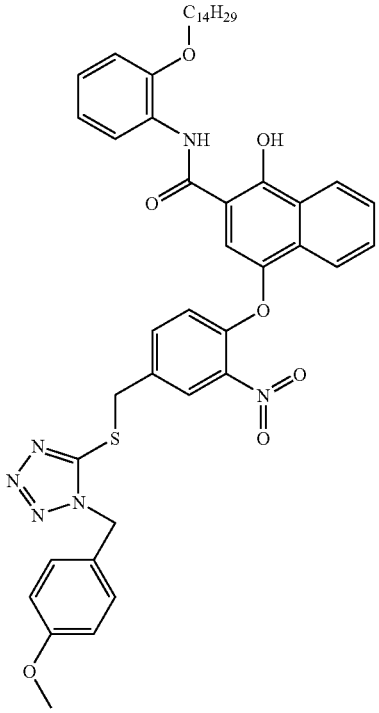
Coup-8
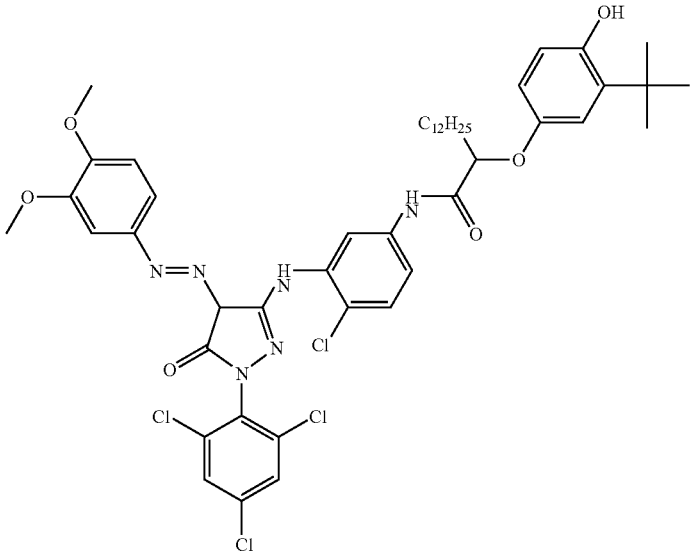
Coup-9

-continued
| Emulsions used in the examples | | | | | |
|---|---|---|---|---|---|
| | | microns | | | |
| Emulsion | type | diameter um | thickness um | % I | Sensitizing Dyes |
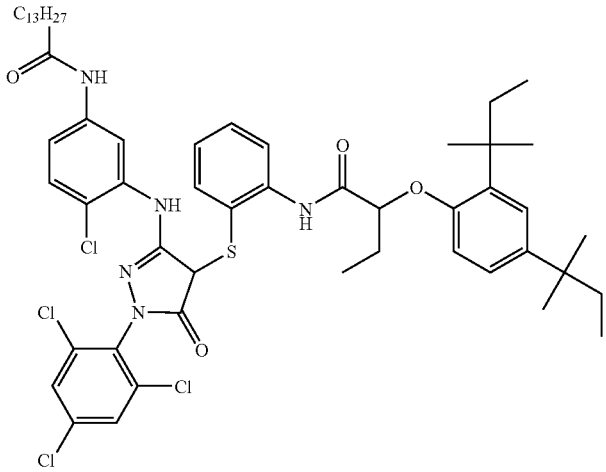
Coup-10
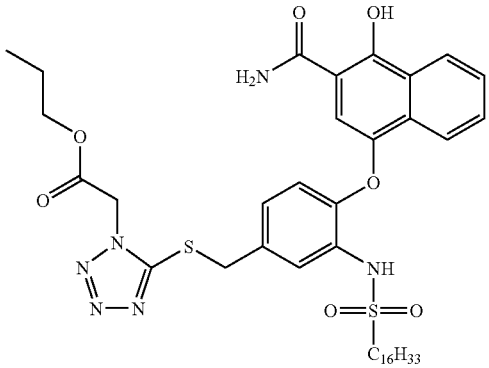
Coup-11 (D4)
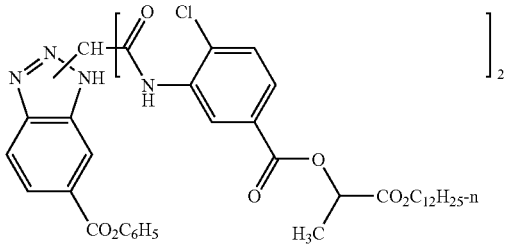
Coup-12

-continued
| Emulsions used in the examples | | | | | |
|---|---|---|---|---|---|
| | | microns | | | |
| Emulsion | type | diameter um | thickness um | % I | Sensitizing Dyes |
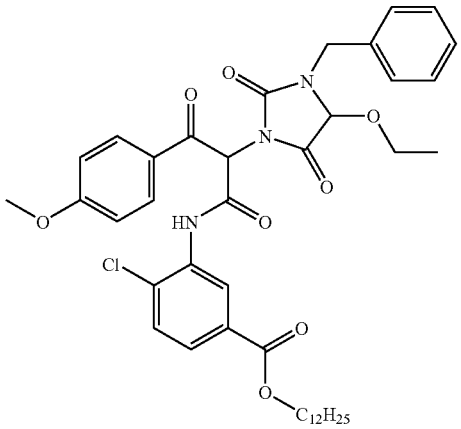
Coup-13 (D11)
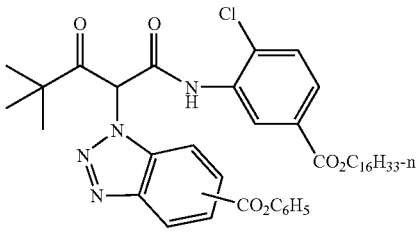
Coup-14
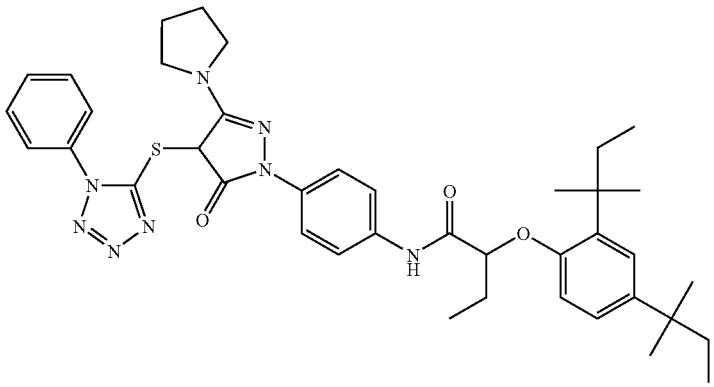
Coup-15

-continued
Emulsions used in the examples
| Emulsion | type | microns diameter um | microns thickness um | % I | Sensitizing Dyes |
|---|---|---|---|---|---|
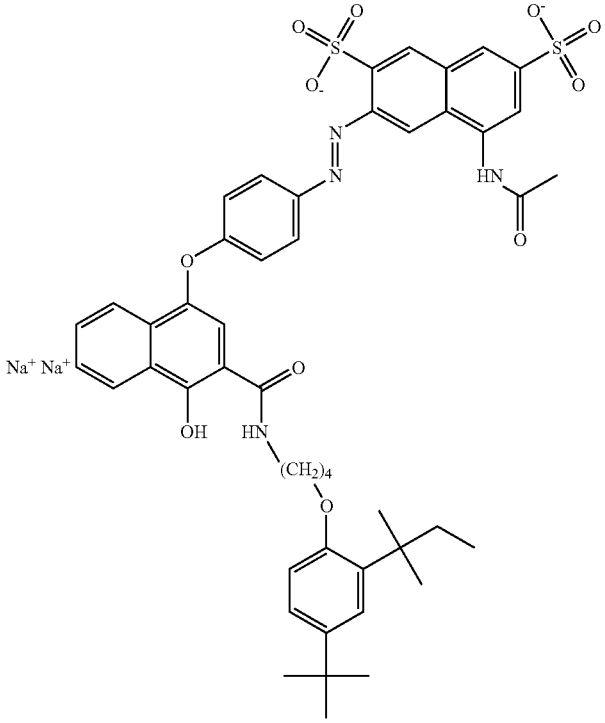
UV-1
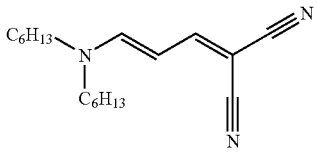
UV-2
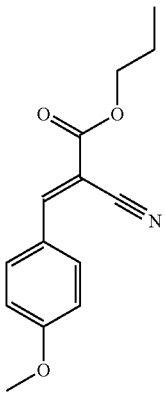
SD-1

-continued
| Emulsions used in the examples | | | | | |
|---|---|---|---|---|---|
| | | microns | | | |
| Emulsion | type | diameter um | thickness um | % I | Sensitizing Dyes |
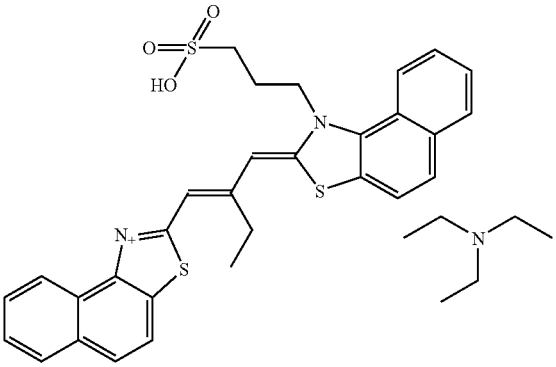
SD-2
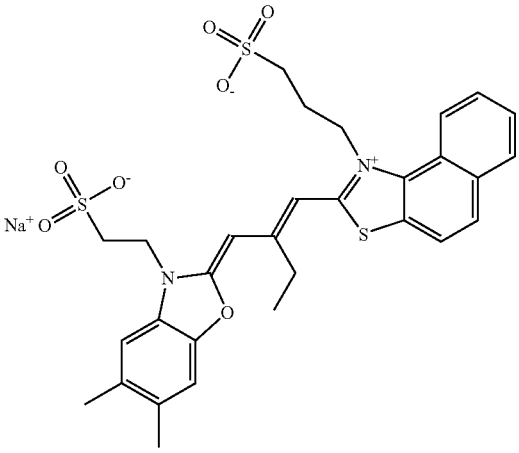
SD-3
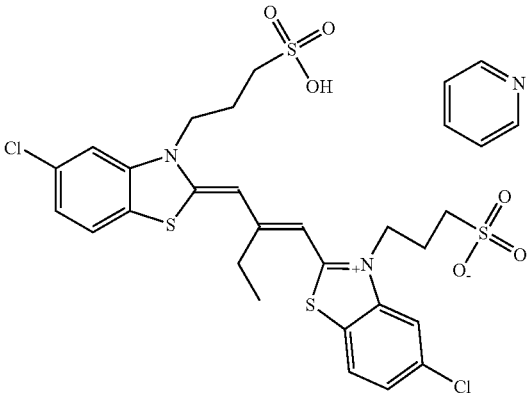
SD-4

-continued
Emulsions used in the examples
| Emulsion | type | microns diameter um | microns thickness um | % I | Sensitizing Dyes |
|---|---|---|---|---|---|
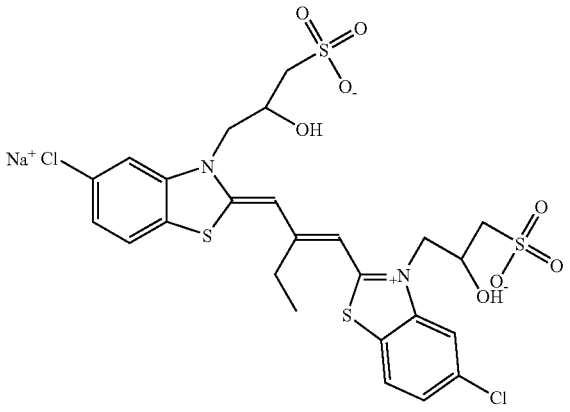
SD-5
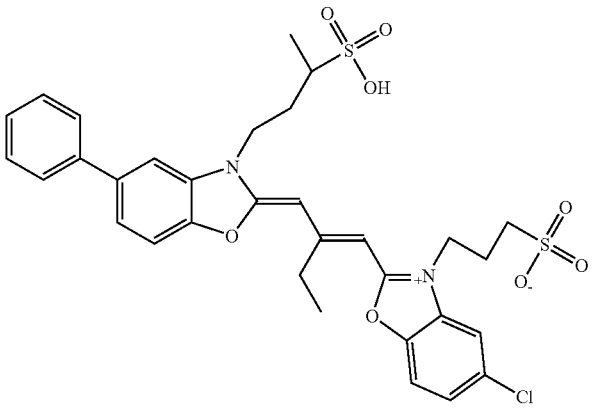
SD-6
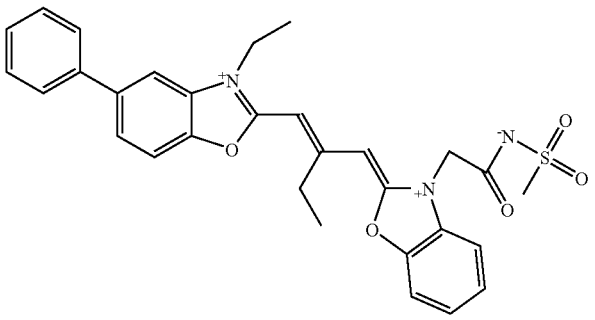
SD-7

-continued

| Emulsions used in the examples | | | | | |
|---|---|---|---|---|---|
| | | microns | | | |
| Emulsion | type | diameter um | thickness um | % I | Sensitizing Dyes |

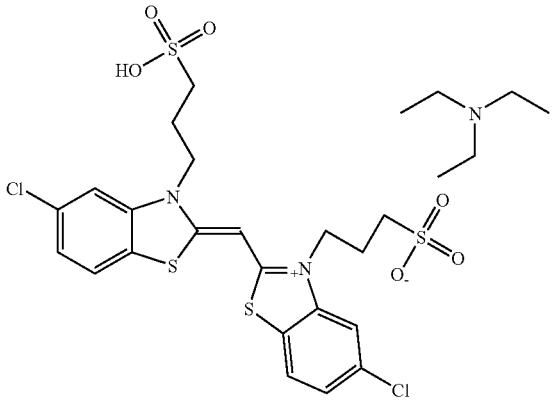

SD-8

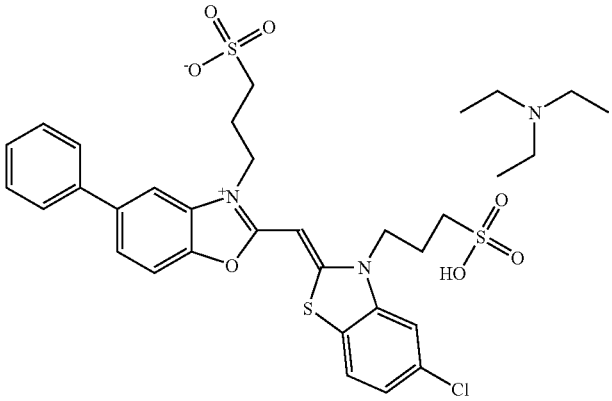

Example 6

Both black and white and color versions (by adding dye forming couplers to the black and white version) of the same film were prepared with and without polymer P-1 which is a material included under the general polymer formula taught by Naoi et al. in U.S. Pat. No. 4,710,456. Contrary to the teaching of Naoi et al, no covering power improvement was seen in either the black and white or in the color version of the film containing polymer P-1 when the films were processed in a black and white process. Furthermore, there was no increase in the film sensitivity (speed) for either version of the film containing polymer P-1 when the films were processed in a black and white process. Surprisingly, however, there was an increase in film sensitivity in the color version (processed in a color process) as revealed in the present invention.

The invention has been described in detail with particular reference to certain preferred embodiments thereof, but it will be understood that variations and modifications can be effected within the spirit and scope of the invention.

What is claimed is:

1. A color silver halide photographic element comprising gelatin, a support bearing at least one dye image forming unit selected from a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler; and a polymer represented by Formula 1, (1)

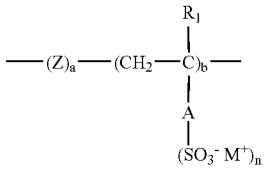

wherein:

A independently represents a bond or a group linking the polymer chain to the $SO_3^-M^+$ group(s), $R_1$ independently represents H or a lower alkyl group of from 1 to 4 carbon atoms, $M^+$ independently represents an alkali or alkaline earth metal ion or an ammonium or substituted ammonium ion, Z independently represents at least one ethylenically unsaturated, hydrophilic monomer, and a and b represent the weight percent of the respective monomers wherein a is between 0 and 95%, b is between 5 and 100%, and n is 1 or 2; and wherein the average molecular weight of the polymer is less than 300,000 and the total amount of the polymer contained in the silver halide element is greater than 1.0% of the total amount of gelatin contained in the silver halide element.

2. The color silver halide photographic element of claim 1 wherein b is greater than 20% by weight.

3. The color silver halide photographic element of claim 1 wherein b is greater than 50% by weight.

4. The color silver halide photographic element of claim 1 wherein b is greater than 70% by weight.

5. The color silver halide photographic element of claim 1 wherein Z is an acrylamide monomer.

6. The color silver halide photographic element of claim 1 wherein A is an acyl or ether group.

7. The color silver halide photographic element of claim 1 wherein A is $C(O)OR_2$, $C(O)NHR_2$, $C(O)NR_3R_2$, $OC(O)R_2$, and $OR_2$, wherein $R_2$ represents an alkylene, cyclic alkylene, or ethyleneoxy group having from 1 to 10 carbon atoms, and $R_3$ is represents H or a lower alkyl group of from 1 to 4 carbon atoms.

8. The color silver halide photographic element of claim 5 wherein A is $C(O)OR_2$, $C(O)NHR_2$, $C(O)NR_3R_2$, $OC(O)R_2$, and $OR_2$, wherein $R_2$ represents an alkylene, cyclic alkylene, or ethyleneoxy group having from 1 to 10 carbon atoms, and $R_3$ is represents H or a lower alkyl group of from 1 to 4 carbon atoms.

9. The color silver halide photographic element of claim 1 wherein the average molecular weight of the polymer is less than 200,000.

10. The color silver halide photographic element of claim 1 wherein the total amount of the polymer contained in the silver halide element is greater than 3.0% of the total amount of gelatin contained in the silver halide element.

11. The color silver halide photographic element of claim 10 wherein the total amount of the polymer contained in the silver halide element is greater than 5.0% of the total amount of gelatin contained in the silver halide element.

12. The color silver halide photographic element of claim 10 wherein the element comprises a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler.

13. The color silver halide photographic element of claim 12 wherein the element comprises a cyan dye image forming unit comprising at least one red sensitive silver halide emulsion layer having associated therewith a cyan dye-forming coupler, a magenta dye image forming unit comprising at least one green sensitive silver halide emulsion layer having associated therewith a magenta dye-forming coupler, and a yellow dye image forming unit comprising at least one blue sensitive silver halide emulsion layer having associated therewith a yellow dye-forming coupler.

14. The color silver halide photographic element of claim 1 wherein the polymer is used in a gelatin containing layer as a partial gelatin replacement.

15. The color silver halide photographic element of claim 14 wherein the polymer replaces 5% to 30% by weight of the gelatin contained in the layer.

16. The color silver halide photographic element of claim 14 wherein the polymer replaces 5% to 20% by weight of the gelatin contained in the layer.

17. The color silver halide photographic element of claim 1 wherein the polymer is added to a gelatin containing layer as an addendum.

18. The color silver halide photographic element of claim 17 wherein the polymer is added in the amount of 5% to 35% by weight of the gelatin contained in the layer.

19. The color silver halide photographic element of claim 17 wherein the polymer is added in the amount of 5% to 25% by weight of the gelatin contained in the layer.

20. The color silver halide photographic element of claim 1 wherein the viscosity of a coating layer melt containing the polymer is no more than 100% higher than the viscosity of the same layer melt without the polymer.

21. The color silver halide photographic element of claim 1 wherein the viscosity of a coating layer melt containing the polymer is no more than 50% higher than the viscosity of the same layer melt without the polymer.

22. The color silver halide photographic element of claim 1 further comprising a dye of the following structure

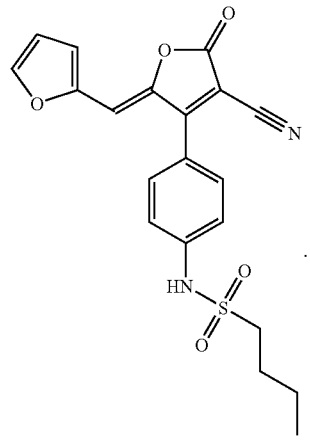

23. The color silver halide photographic element of claim 22 wherein the dye is in the same layer as the polymer.

24. The color silver halide photographic element of claim 23 wherein the dye containing layer is a non-imaging layer.

25. A method of processing a color silver halide photographic element comprising gelatin, a support bearing at least one dye image forming unit selected from a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler; and a polymer represented by Formula 1;

(1)

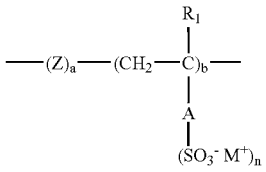

wherein:

A independently represents a bond or a group linking the polymer chain to the $SO_3^-M^+$ group(s), $R_1$ independently represents H or a lower alkyl group of from 1 to 4 carbon atoms, $M^+$ independently represents an alkali or alkaline earth metal ion or an ammonium or substituted ammonium ion, Z independently represents at least one ethylenically unsaturated, hydrophilic monomer, and a and b represent the weight percent of the respective monomers where a is between 0 and 95%, b is between 5 and 100%, and n is 1 or 2, and wherein the average molecular weight of the polymer is less than 300,000 and the total amount of the polymer contained in the silver halide element is greater than 1.0% of the total amount of gelatin contained in the silver halide element; said method comprising developing the silver halide element with a color developer, and then bleaching and fixing or bleach/fixing the silver halide element.

26. The method of claim 25 wherein b is greater than 20% by weight.

27. The method of claim 25 wherein b is greater than 50% by weight.

28. The method of claim 25 wherein b is greater than 70% by weight.

29. The method of claim 25 wherein Z is an acrylamide monomer.

30. The color silver halide photographic element of claim 25 wherein A is an acyl or ether group.

31. The method of claim 30 wherein A is $C(O)OR_2$, $C(O)NHR_2$, $C(O)NR_3R_2$, $OC(O)R_2$, and $OR_2$, wherein $R_2$ represents an alkylene, cyclic alkylene, or ethyleneoxy group having from 1 to 10 carbon atoms, and $R_3$ represents H or a lower alkyl group of from 1 to 4 carbon atoms.

32. The method of claim 29 wherein A is $C(O)OR_2$, $C(O)NHR_2$, $C(O)NR_3R_2$, $OC(O)R_2$, and $OR_2$, wherein $R_2$ represents an alkylene, cyclic alkylene, or ethyleneoxy group having from 1 to 10 carbon atoms, and $R_3$ represents H or a lower alkyl group of from 1 to 4 carbon atoms.

33. The method of claim 25 wherein the average molecular weight of the polymer is less than 200,000.

34. The method of claim 25 wherein the total amount of the polymer contained in the silver halide element is greater than 3.0% of the total amount of gelatin contained in the silver halide element.

35. The method of claim 25 wherein the total amount of the polymer contained in the silver halide element is greater than 5.0% of the total amount of gelatin contained in the silver halide element.

36. The method of claim 25 wherein the element comprises a dye image forming unit comprising at least one red sensitive silver halide emulsion layer having associated therewith a dye-forming coupler, a dye image forming unit comprising at least one green sensitive silver halide emulsion layer having associated therewith a dye-forming coupler, and a dye image forming unit comprising at least one blue sensitive silver halide emulsion layer having associated therewith a dye-forming coupler.

37. The method of claim 25 wherein the element comprises a cyan dye image forming unit comprising at least one red sensitive silver halide emulsion layer having associated therewith a cyan dye-forming coupler, a magenta dye image forming unit comprising at least one green sensitive silver halide emulsion layer having associated therewith a magenta dye-forming coupler, and a yellow dye image forming unit comprising at least one blue sensitive silver halide emulsion layer having associated therewith a yellow dye-forming coupler.

38. The method of claim 25 wherein the polymer is used in a gelatin containing layer as a partial gelatin replacement.

39. The method of claim 38 wherein the polymer replaces 5% to 30% by weight of the gelatin contained in the layer.

40. The method of claim 25 wherein the polymer is added to a gelatin containing layer as an addendum.

41. The method of claim 40 wherein the polymer is added in the amount of 5% to 35% by weight of the gelatin contained in the layer.

42. The method of claim 25 wherein the viscosity of a coating layer melt containing the polymer is no more than 100% higher than the viscosity of the same layer melt without the polymer.

43. The method of claim 25 wherein the viscosity of a coating layer melt containing the polymer is no more than 50% higher than the viscosity of the same layer melt without the polymer.

44. The method of claim 25 further comprising a dye of the following structure:

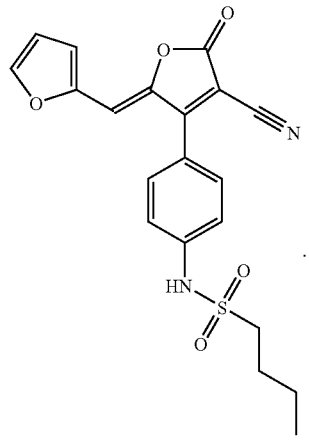

45. The method of claim 44 wherein the dye is in the same layer as the polymer.

46. The method of claim 45 wherein the dye containing layer is a non-imaging layer.

* * * * *